US009562422B2

(12) United States Patent
Sharma et al.

(10) Patent No.: US 9,562,422 B2
(45) Date of Patent: Feb. 7, 2017

(54) SYSTEM AND METHODS FOR INJECTION AND PRODUCTION FROM A SINGLE WELLBORE

(71) Applicant: The Board of Regents of the University of Texas System, Austin, TX (US)

(72) Inventors: Mukul Mani Sharma, Austin, TX (US); Ripudaman Manchanda, Austin, TX (US); Evan Daniel Gilmore, Dallas, TX (US)

(73) Assignee: Board of Regents of the University of Texas Systems, Austin, TX (US)

( * ) Notice: Subject to any disclaimer, the term of this patent is extended or adjusted under 35 U.S.C. 154(b) by 4 days.

(21) Appl. No.: 14/395,726

(22) PCT Filed: Apr. 19, 2013

(86) PCT No.: PCT/US2013/037392

§ 371 (c)(1),
(2) Date: Oct. 20, 2014

(87) PCT Pub. No.: WO2013/159007

PCT Pub. Date: Oct. 24, 2013

(65) Prior Publication Data

US 2015/0096756 A1 Apr. 9, 2015

Related U.S. Application Data

(60) Provisional application No. 61/636,319, filed on Apr. 20, 2012.

(51) Int. Cl.
*E21B 43/14* (2006.01)
*E21B 33/124* (2006.01)
(Continued)

(52) U.S. Cl.
CPC ..... *E21B 43/16* (2013.01); *E21B 43/24* (2013.01); *E21B 43/26* (2013.01)

(58) Field of Classification Search
CPC ..... E21B 43/24; E21B 34/14; E21B 43/162; E21B 21/103; E21B 43/12; E21B 43/121; E21B 43/14
See application file for complete search history.

(56) References Cited

U.S. PATENT DOCUMENTS 5,024,275 A 6/1991 Anderson et al.
5,131,471 A 7/1992 Duerksen et al.
(Continued)

OTHER PUBLICATIONS

International Search Report/Written Opinion for PCT Patent Application No. PCT/US2013/037392 issued Aug. 14, 2013.
(Continued)

*Primary Examiner* — Catherine Loikith
*Assistant Examiner* — Charles R Nold
(74) *Attorney, Agent, or Firm* — Meyertons, Hood, Kivlin, Kowert & Goetzel, P.C.; Eric B. Meyertons

(57) ABSTRACT

Methods and systems of treating hydrocarbon containing formations are described herein. A system for treating a subterranean hydrocarbon containing formation includes a wellbore, and one or more packers positioned in the wellbore. At least one of the packers allows fluid to be injected in a subterranean hydrocarbon containing formation while allowing fluid to be produced from the wellbore.

24 Claims, 8 Drawing Sheets

(51) Int. Cl.

| | |
|---|---|
| ***E21B 43/16*** | (2006.01) |
| ***E21B 43/24*** | (2006.01) |
| ***E21B 43/26*** | (2006.01) |

(56) References Cited

U.S. PATENT DOCUMENTS

| | | | | |
|---|---|---|---|---|
| 5,133,407 | A | 7/1992 | Deines et al. | |
| 6,234,247 | B1 * | 5/2001 | Head | E21B 23/02 166/106 |
| 6,298,916 | B1 * | 10/2001 | Tibbles | E21B 34/14 166/145 |
| 6,315,050 | B2 * | 11/2001 | Vaynshteyn | 166/376 |
| 6,817,410 | B2 * | 11/2004 | Wetzel | E21B 47/09 166/233 |
| 2002/0088621 | A1 | 7/2002 | Hamilton et al. | |
| 2002/0096328 | A1 * | 7/2002 | Echols | E21B 43/14 166/278 |
| 2005/0051329 | A1 * | 3/2005 | Blaisdell | E21B 49/084 166/264 |
| 2006/0060352 | A1 * | 3/2006 | Vidrine | E21B 43/045 166/276 |
| 2006/0207765 | A1 | 9/2006 | Hofman | |
| 2009/0114385 | A1 | 5/2009 | Lumbye | |
| 2009/0294128 | A1 * | 12/2009 | Dale | E21B 43/04 166/306 |
| 2011/0036576 | A1 | 2/2011 | Schultz et al. | |

OTHER PUBLICATIONS

International Preliminary Report on Patentability for PCT Patent Application No. PCT/US2013/037392 issued Oct. 21, 2014.

* cited by examiner

SYSTEM AND METHODS FOR INJECTION AND PRODUCTION FROM A SINGLE WELLBORE

BACKGROUND

1. Field of the Invention

The present invention relates generally to methods and systems for production of hydrocarbons and/or other products from various subsurface formations such as hydrocarbon containing formations.

2. Description of Related Art

Hydrocarbons obtained from subterranean formations are often used as energy resources, as feedstocks, and as consumer products. Concerns over depletion of available hydrocarbon resources and concerns over declining overall quality of produced hydrocarbons have led to development of processes for recovery that is more efficient, processing and/or use of available hydrocarbon resources. In-situ processes may be used to remove hydrocarbon materials from subterranean formations that were previously inaccessible and/or too expensive to extract using available methods.

Substantial reserves of hydrocarbons exist in formations that have relatively low permeability. Examples of such formations include the Eagle Ford shale, the Barnett shale, the Travis Peak and Cotton Valley formations and the Bakken shale. Several methods have been proposed and/or used for producing heavy hydrocarbons from relatively low permeability formations. Recovery of hydrocarbons from low permeability subterranean formations is difficult because of the low mobility of fluids in the pore space in the subterranean formation (ultra-low permeability rocks). This makes the production and injection of fluids from such reservoirs very difficult. Similar problems are encountered in heavy oil reservoirs (reservoirs containing crude oil with a viscosity larger than about 100 centipoise). Mobility of the fluids in heavy oil reservoirs is small, and thus, injecting and producing from such hydrocarbon bearing rock is difficult.

U.S. Pat. No. 5,289,881 to Schuh describes a horizontal well completion apparatus and method for heavy, viscous oil in a producing zone using a single well. Hot injection fluid is injected into an injection string, reduced to a lower pressure by passing the injection fluid through a choke. A packer separates the upper well annulus from the lower well annulus. Insulation surrounds injection tubing string between the packer and the wellhead. Perforations in the horizontal portion of the well allow heated oil to flow into the lower annulus in the horizontal portion of the well where is picked up by the injected fluid and lifted to the surface of the well by a jet pump. The temperature and pressure of the injection fluid, and the pumping rate of the produced fluids control temperature and pressure in the lower well annulus.

Oil recovery by primary production (hydrocarbon production accomplished using the natural energy in the reservoir) is usually very low for unconventional oil and gas reservoirs. In unconventional reservoirs such as the Bakken and Eagle Ford formations, typical primary production is about 5% of the original oil in place compared to 15 to 25% in permeable subterranean formations. Thus, a very large resource of hydrocarbons is left unrecovered.

In conventional (high permeability) reservoirs, water injection and enhanced oil recovery methods such as $CO_2$ flooding and chemical injection are used to recover additional hydrocarbons. The use of these methods is restricted by the inability to inject at sufficiently high rates into low permeability or heavy oil reservoirs. During injection processes, the injection pressures is limited as the subterranean formation will fracture once the fracture gradient of the rock is exceeded. Since the injection pressure and/or rate is limited, injection of fluids takes time and may have little to no impact on hydrocarbon production. For example, in a chemical flooding process, a minimum of 0.25 times the hydrocarbon pore volume of the reservoir area being flooded may be required to see any incremental oil recovery. In low permeability formations, achieving this may take many decades (or at least many years).

Although, there has been a significant amount of effort to develop methods and systems to produce hydrocarbons and/or other products from relatively low permeability formations, there is still a need for improved methods and systems for production of hydrocarbons.

SUMMARY

Methods and systems of treating hydrocarbon containing formations are described herein. In some embodiments, a system for treating a subterranean hydrocarbon containing formation includes a wellbore in the subterranean hydrocarbon containing formation; a first packer positioned in the wellbore, wherein the first packer allows fluid to be injected in a subterranean hydrocarbon containing formation; and a second packer positioned in the wellbore and in fluid communication with the first packer, wherein the second packer allows fluid to be produced from the wellbore, and is in fluid communication with the first packer.

In some embodiments, a method for treating a subterranean hydrocarbon containing formation includes providing a substantially horizontal or deviated wellbore to a subterranean hydrocarbon containing formation; providing a plurality of packers to the substantially horizontal or deviated wellbore; providing injection fluid to at least a first section of the hydrocarbon and/or a second section of the containing formation through at a first packer and/or a second packer; and mobilizing hydrocarbons from at least a third section of the hydrocarbon containing formation through a third packer, wherein the third section of the hydrocarbon containing formation is between the first and second section of the hydrocarbon containing formation.

In some embodiments, a method for injecting and producing from a single wellbore in a subterranean hydrocarbon containing formation includes providing injection fluid to at least a first section of the hydrocarbon containing formation from a wellbore in the subterranean hydrocarbon containing formation; mobilizing formation fluids from the first section to a second section of the hydrocarbon formation, the second section being located substantially adjacent to the first section and at least partially horizontally displaced from the first section, and producing the mobilized fluid from second section through the wellbore.

In some embodiments, a method for injecting and producing from a single wellbore in a subterranean hydrocarbon containing formation includes providing a substantially horizontal or deviated wellbore to a subterranean hydrocarbon containing formation; providing a plurality of packers to the substantially horizontal or deviated wellbore, wherein a first packer is horizontally displaced from a second packer of the plurality of packers; providing injection fluid to at least a first section of the hydrocarbon containing formation through the first packer in a first portion of the wellbore; mobilizing hydrocarbons from the first section of the hydrocarbon formation to a second portion of the wellbore, wherein the second portion of the wellbore comprises a second packer in fluid communication with the first packer, and producing the mobilized hydrocarbons from the wellbore.

In some embodiments, a method for injecting and producing from a single wellbore in a subterranean hydrocarbon containing formation includes providing a substantially horizontal or deviated wellbore to a subterranean hydrocarbon containing formation; providing a plurality of packers to the substantially horizontal or deviated wellbore, wherein a first packer is horizontally displaced from a second packer of the plurality of packers; providing injection fluid to at least a first section of the hydrocarbon containing formation by flowing injection fluid through the first packer; and mobilizing hydrocarbons from the first section of the hydrocarbon formation to a second section of the wellbore, wherein the second section of the wellbore comprises a second packer in fluid communication with the first packer, and producing the mobilized fluid from the wellbore.

In some embodiments, a method for injecting and producing from a single wellbore in a subterranean hydrocarbon containing formation includes providing a substantially horizontal or deviated wellbore to a subterranean hydrocarbon containing formation; providing a plurality of packers to the substantially horizontal or deviated wellbore, wherein a first packer is horizontally displaced from a second packer of the plurality of packers; providing injection fluid to at least a first section of the hydrocarbon containing formation by flowing injection fluid through the first packer; and mobilizing hydrocarbons from at least a second section of the hydrocarbon containing formation through the second packer, and producing the mobilized fluid from the wellbore.

In some embodiments, a method for injecting and producing from a single wellbore in a subterranean hydrocarbon containing formation includes providing a wellbore to the hydrocarbon containing formation, wherein the wellbore includes perforations; opening and/or closing at least some of the perforations adjacent to at least a first section and/or at least third section of the hydrocarbon containing formation to inject or inhibit injection fluid to at least the first section and/or at least the third section of the hydrocarbon containing formation; mobilizing formation fluids from the at least first section and/or the at least third section to at least a second section and/or at least a fourth section of the hydrocarbon containing formation; opening and/or closing at least some of the perforations adjacent to the second section and/or the fourth section to allow or to inhibit the mobilized formation fluids to flow into at least a portion of the of the wellbore adjacent to the second section and/or the fourth section of the hydrocarbon containing formation; and producing the formation fluids through the wellbore.

In some embodiments, a method for producing fractures in a subterranean hydrocarbon containing formation using a single wellbore includes providing a fluid to a wellbore in the subterranean hydrocarbon containing formation, wherein the wellbore includes covered perforations adjacent to at least three sections of the hydrocarbon formation, and wherein the perforations are separated by at least one packer; opening at least some of the perforations to allow fluid to enter the first section of the hydrocarbon containing formation; pressurizing the fluid to form fractures in the first section of the hydrocarbon containing formation; opening at least some of the perforations to allow fluid to enter a second section of the hydrocarbon containing formation; pressurizing the fluid to form fractures in the second section of the hydrocarbon containing formation; opening at least some of the perforations to allow fluid to enter a third section of the hydrocarbon containing formation; and pressurizing the fluid to form fractures in the third section of the hydrocarbon containing formation, wherein the third section is between the first and second sections.

A system for treating a subterranean hydrocarbon containing formation includes a wellbore in the subterranean hydrocarbon containing formation; a plurality of packers positioned in the wellbore, wherein the packers are in fluid communication with an annulus of the wellbore, and wherein at least two packers inhibit fluid communication between a portion of the wellbore annulus positioned between the two packers of the plurality of packers and a portion the wellbore annulus adjoining at least one of the packers In further embodiments, features from specific embodiments may be combined with features from other embodiments. For example, features from one embodiment may be combined with features from any of the other embodiments.

In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
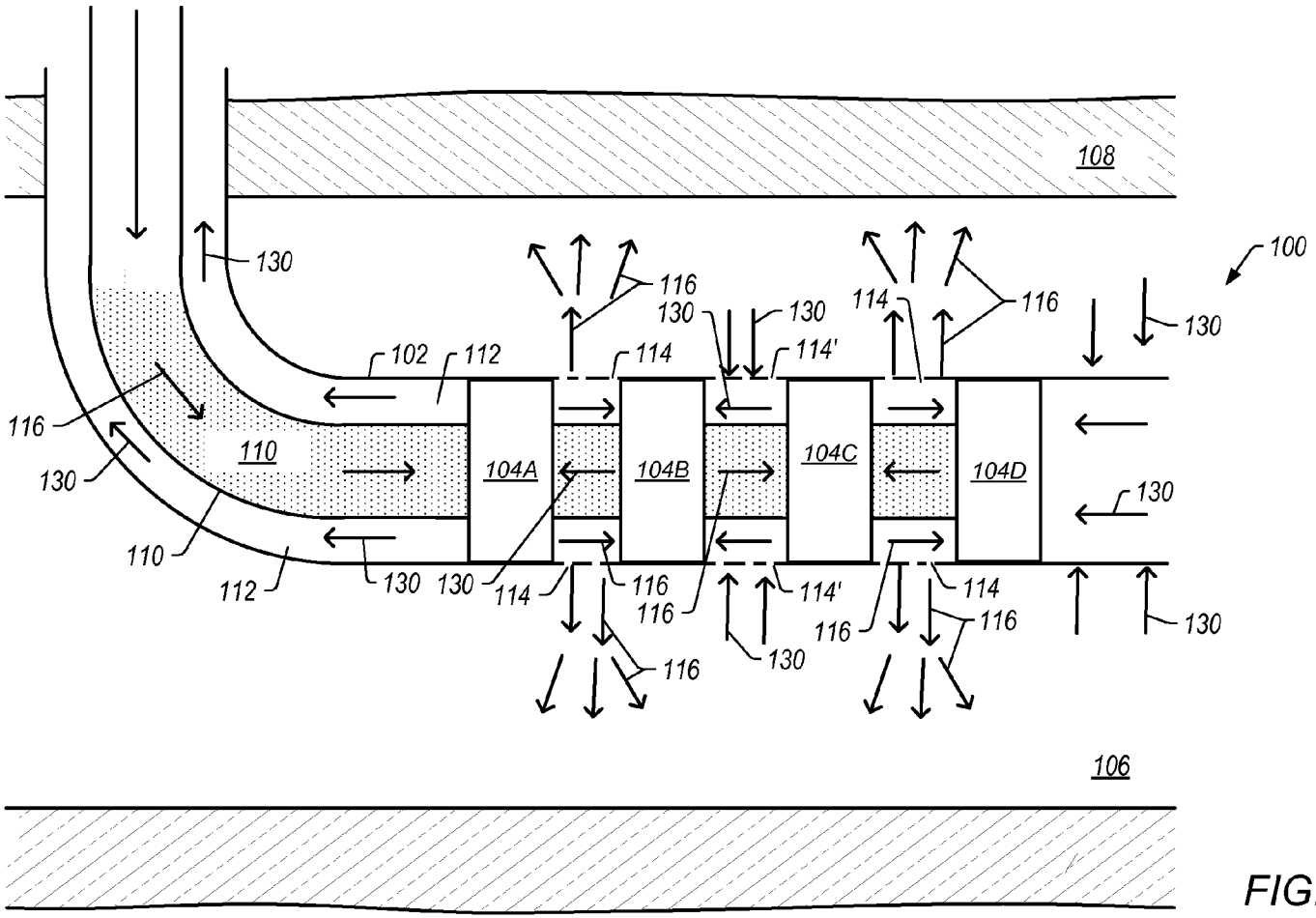
FIG. 1 depicts a schematic side view of an embodiment of injection of fluids and production of hydrocarbons from a hydrocarbon containing formation.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION

The following description generally relates to systems and methods for treating hydrocarbons in the formations. Such formations may be treated to yield hydrocarbon products and other products.

"API gravity" refers to API gravity at 15.5° C. (60° F.). API gravity is as determined by ASTM Method D6822 or ASTM Method D1298.

A "fluid" may be, but is not limited to, a gas, a liquid, an emulsion, a slurry, and/or a stream of solid particles that has flow characteristics similar to liquid flow.

A "formation" includes one or more hydrocarbon containing layers, one or more non-hydrocarbon layers, an overburden, and/or an underburden. "Hydrocarbon layers" refer to layers in the formation that contain hydrocarbons. The hydrocarbon layers may contain non-hydrocarbon material and hydrocarbon material. The "overburden" and/or the "underburden" include one or more different types of impermeable materials. For example, the overburden and/or underburden may include rock, shale, mudstone, or wet/tight carbonate.

"Formation fluids" refer to fluids present in a formation and may include gases and liquids produced from a formation. Formation fluids may include hydrocarbon fluids as well as non-hydrocarbon fluids. Examples of formation fluids include inert gases, hydrocarbon gases, carbon oxides, mobilized hydrocarbons, water (steam), and mixtures thereof. The term "mobilized fluid" refers to fluids in a hydrocarbon containing formation that are able to flow as a result of thermal treatment of the formation. "Produced fluids" refer to fluids removed from the formation.

"Fracture" refers to a crack or surface of breakage within a rock. A fracture along which there has been lateral displacement may be termed a fault. When walls of a fracture have moved only normal to each other, the fracture may be termed a joint. Fractures may enhance permeability of rocks greatly by connecting pores together, and for that reason, joints and faults may be induced mechanically in some reservoirs in order to increase fluid flow.

"Heavy hydrocarbons" are viscous hydrocarbon fluids. Heavy hydrocarbons may include highly viscous hydrocarbon fluids such as heavy oil, tar, oil sands, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20°. Heavy oil, for example, generally has an API gravity of about 10-20°, whereas tar generally has an API gravity below about 10°. The viscosity of heavy hydrocarbons is generally greater than about 100 centipoise at 15° C. Heavy hydrocarbons may include aromatics or other complex ring hydrocarbons.

Heavy hydrocarbons may be found in a relatively permeable formation. The relatively permeable formation may include heavy hydrocarbons entrained in, for example, sand, or carbonate. "Relatively permeable" is defined, with respect to formations or portions thereof, as an average permeability of 10 millidarcy or more (for example, 10 or 100 millidarcy). "Relatively low permeability" is defined, with respect to formations or portions thereof, as an average permeability of less than about 10 millidarcy. One darcy is equal to about 0.99 square micrometers. A low permeability layer generally has a permeability of less than about 0.1 millidarcy.

"Hydrocarbons" are generally defined as molecules formed primarily by carbon and hydrogen atoms. Hydrocarbons may also include other elements such as, but not limited to, halogens, metallic elements, nitrogen, oxygen, and/or sulfur. Hydrocarbons may be, but are not limited to, kerogen, bitumen, pyrobitumen, oils, natural mineral waxes, and asphaltites. Hydrocarbons may be located in or adjacent to mineral matrices in the earth. Matrices may include, but are not limited to, sedimentary rock, sands, silicilytes, carbonates, diatomites, and other porous media. "Hydrocarbon fluids" are fluids that include hydrocarbons. Hydrocarbon fluids may include, entrain, or be entrained in non-hydrocarbon fluids such as hydrogen, nitrogen, carbon monoxide, carbon dioxide, hydrogen sulfide, water, and ammonia.

"Hydraulic fracturing" refers to creating or opening fractures that extend from the wellbore into formations. A fracturing fluid, typically viscous, may be injected into the formation with sufficient hydraulic pressure (for example, at a pressure greater than the lithostatic pressure of the formation) to create and extend fractures, open preexisting natural fractures, or cause slippage of faults. In the formations discussed herein, natural fractures and faults may be opened by pressure. A proppant may be used to "prop" or hold open the fractures after the hydraulic pressure has been released. The fractures may be useful for allowing fluid flow, for example, through a shale formation, or a geothermal energy source, such as a hot dry rock layer, among others.

"Perforations" include openings, slits, apertures, or holes in a wall of a conduit, tubular, pipe or other flow pathway that allow flow into or out of the conduit, tubular, pipe or other flow pathway.

"Packers" include any kind of device placed inside a wellbore that isolates the injection fluid from the production fluid and directs these fluids to either an annulus or one or more tubing strings. Multiple packers may be placed inside a wellbore.

The term "wellbore" refers to a hole in a formation made by drilling or insertion of a conduit into the formation. A wellbore may have a substantially circular cross section, or another cross-sectional shape. The wellbore may be open-hole or may be cased and cemented. As used herein, the terms "well" and "opening," when referring to an opening in the formation may be used interchangeably with the term "wellbore." "Horizontal wellbore" refers to a portion of a wellbore in a subterranean hydrocarbon containing formation to be completed that is substantially horizontal or deviated at an angle from horizontal in the range of from about 0° to about 15°.

Recovery of hydrocarbons may be more economically feasible in low permeability reservoirs by improving the ability to inject into a formation (for example, reservoir) and to reduce the volume of the formation (for example, reservoir) that is being impacted by any injection or production location in the wellbore. Reducing the volume of formation may reduce the time needed to recover hydrocarbons. Thus, conventional recovery methods may be practical to use in low permeability subterranean formations. Multiple injection and production locations along a single wellbore may effectively break up the formation (from which hydrocarbons are being produced) into smaller volumetric pieces, and increases the total injection and production rate, if these wellbore locations are hydraulically fractured. For example, in a conventional reservoir, with a modest permeability of 10 millidarcy and a porosity of 20%, injection into a 50 feet thick reservoir at 1000 bbl/day would take 1 year to inject 0.25 pore volume of fluid. If the permeability were to be decreased to 0.01 millidarcy, the injection rate would drop by 1,000 times and it would take 1,000 years to inject 0.25 pore volume of fluid. If, however, 50 locations or points of injection and/or production were available along a wellbore, the ability to inject and/or produce at about 50 times the rate may be possible from the single wellbore, and the area (and pore volume) that needs to be flooded per injection point is reduced by 50 times. Thus, the target injection volume may be reached in less than 20 years. In some embodiments, hydraulically fracturing an injection location or set of locations would increase the injection area of the formation by a factor of 100. Thus, allowing injection of more water, gas, heat, and/or improving hydrocarbon recovery chemical in about 1 or 2 years. In addition, injected fluids may more efficiently contact and displace the hydrocarbons. The incorporation of multiple injection and production points in a single wellbore, therefore, allows improved recovery methods to be more efficiently applicable in low permeability reservoirs.

Heavy oil reservoirs where the oil viscosity is many orders of magnitude higher than conventional oil reservoirs may be treated in the same manner. Production and injection of fluids is limited due to high fluid viscosity. In conventional methods, injection and production from a low permeability formation takes a long time and the fluid rates are typically low. Thus, conventional processes may be deemed uneconomical.

Injecting fluids at a higher temperature leads to a decrease in viscosity of the hydrocarbon fluids in the reservoir. Thus, volumetrically dividing the reservoir into various segments may lead to an increase in the contact area of the hot injection fluid with the formation fluid. The use of multiple injection and production points from a single wellbore, therefore, may facilitate more recovery of hydrocarbon from these heavy oil reservoirs.

A hydrocarbon containing formation may be treated using enhanced oil recovery methods (for example, a chemical injection process, a water injection process, a gas injection process and/or a steam injection process). Injection fluid may be provided to the formation. The injected fluid may displace, miscible or immiscibly, hydrocarbons towards the production wellbore by reducing the viscosity, reducing the interfacial tension of the fluids, solubilizing or emulsifying the hydrocarbons in the formation. Reduction in the viscosity allows the fluid to more easily drain and be produced from the production wellbore.

In a conventional injection or production process, fluid injection may not treat the formation uniformly. For example, steam injection may not be uniform throughout the formation. Chemicals may move selectively in high permeability channels. Gravity segregation will occur when $CO_2$ or hydrocarbon gases are injected. Variations in the properties of the formation (for example, fluid injectivities, permeabilities, and/or porosities) may result in non-uniform injection of the injection fluid through the formation. Because of the non-uniform injection of the injection fluid (for example, steam), the injection fluid may remove hydrocarbons from different portions of the formation at different rates or with different results. For example, some portions of the formation may have little or no fluid injectivity, which inhibits the hydrocarbon production from these portions. After the fluid injection process is completed, the formation may have portions that have lower amounts of hydrocarbons produced (more hydrocarbons remaining) than other parts of the formation. These effects become more and more pronounced as the distance between the injection and production locations increases.

The ability to inject and/or produce from multiple places in a single wellbore allows a decrease in the distance between injection and production locations and an increase in the rate of injection and production, as compared to conventional two wellbore processes and/or wellbores that allow injection at the end of the wellbore and production from the opposite end of the wellbore. Multiple injection and production locations along the length of a single wellbore allow selective injection of fluids into the hydrocarbon layer and selective production of formation fluids from the hydrocarbon layer using a single wellbore. The methods and systems described herein allow injection and production of fluids, or heating from multiple places in a single substantially horizontal, deviated wellbore, or vertical wellbore and/or fracturing of multiple sections of a hydrocarbon containing formation.

The inability to treat hydrocarbon containing formations (for example, relatively low permeability hydrocarbon containing formation) may be improved by reducing the distance between the injection and production points and increasing the contact area of the reservoir with the wellbore. Using multiple injection and production points in a single wellbore allows significant reduction in the distance between the injection and production points. Reduction in the distance between the injection and production points may reduce the time required to inject and produce fluids for any given improved recovery method. The reduction in such a distance provides efficient placement of injected fluids and, therefore, efficient displacement of hydrocarbons from the formation. The ability of the injected fluids to displace hydrocarbons enhances a contact area of the wellbore containing injection fluid with the formation. In addition, injection of fluids in such a manner provides an efficient displacement geometry (for example, a line drive). Injecting and producing using a single wellbore also improves fluid drainage and injection as compared to using an injection wellbore and a production wellbore.

In certain embodiments, subterranean hydrocarbon containing formations are treated using a single wellbore for injection of fluid and production of formation fluids. By simultaneously injecting fluid and producing hydrocarbons using selective injection and production sections in a single wellbore the distance between the injection and production portions in the reservoir is reduced, and contact area of the hydrocarbon containing formation with the wellbore is increased, as compared to conventional two wellbore production methods. Thus, displacement (for example, mobilization) of hydrocarbons is enhanced, and more hydrocarbons are produced per area of hydrocarbon layer. Simultaneously injecting fluid and producing hydrocarbons from a single wellbore may allow production from hydrocarbon layers that are deemed uneconomical to produce using conventional chemical or steam flooding methods. For example, hydrocarbons may be produced from a 20 to 40 acre reservoir, with a conventional five spot well pattern, using chemical or steam flooding through wellbores that include crossover packers or other embodiments that allow selective injection and production sections.

The methods and systems described herein allow selective control (for example, location and rates) of injection and production, from each location along the wellbore using, for example, sliding sleeves. For example, if a certain production location is producing mostly water it may be possible in some embodiments to shut-in (close) this production location. Similarly, if injection of fluids is no into a certain location of the hydrocarbon layer, that location of the wellbore may be shut off (closed) and the fluid will automatically be redirected to another location of the wellbore and ultimately into the hydrocarbon layer.

In some embodiments, a flow control device may be used to allow for independent control of injection and/or production rates at injection and/or production locations in the well. In some embodiments, different rates of injection and/or production are desired at different locations along the length of the wellbore. A flow control device, such as, but not limited to, sliding sleeves, may be used to control rates of production and/or injection. In some embodiments, flow control devices may control rates of production and/or injection by limiting production and/or injection at one location along the length of the wellbore while allowing for greater flow at another location along the length of the wellbore. The flow control device may allow for different production and/or injection rates at various production and/or injection locations in the single wellbore.

In some embodiments, use of a single wellbore for injecting and producing fluids enhances hydrocarbon recovery processes such as water flooding, enhanced oil recovery (chemical flooding, $CO_2$ flooding, steam flooding etc.).

In some embodiments, injection of fluid into a hydrocarbon containing section currently being produced and/or a hydrocarbon section after production. In some embodiments, production of fluids is performed from a treated section (for example, a section treated with injection fluid) or a section undergoing treatment (for example, a section being treated with injection fluids). For example, production from sections of the hydrocarbon containing formation may be performed by allowing injection fluids to flow through hydrocarbon section being produced. In another example, injection of fluids into a section of the hydrocarbon containing formation may be ceased and production of the formation fluids from the treated section is started.

In some embodiments, the single wellbore for injecting and producing fluids may be used for only injection or only production. The single wellbore described herein for production may be used to inject the fluids into the subterranean hydrocarbon containing formation, thus allowing only injection. Similarly, a single wellbore described herein for injection may be used to produce the fluids from the subterranean hydrocarbon containing formation, thus allowing only production.

In some embodiments, a multiple injection and production wellbore is used to stimulate a well and/or create fractures. For example, acidizing a well, well stimulation acidizing, and/or hydraulic fracturing of a well. The use of an injection and producing wellbore may reduce fracturing times by placing two or more fractures simultaneously. For example, fluid injected into a section of a hydrocarbon containing formation may be pressurized. The pressurized fluid enters the formation and may create fractures in at least two portions of the hydrocarbon containing formation at the same time.

Use of a single wellbore may improve the amount of hydrocarbons recovered from the hydrocarbon containing formation as compared to conventional methods. For example, at least about 15%, at least about 30%, at least about 55%, or at least about 90% more hydrocarbons may be recovered from the formation as compared to a water flood or steam drive process using a two wellbore system. In some embodiments, the fluids produced from the formation are mobilized fluids. Producing mobilized fluids may also increase the total amount of hydrocarbons produced from oil shales, tar sands and oil sands.

The produced mixture may have assessable properties (for example, measurable properties). The produced mixture properties are determined by operating conditions in the formation being treated (for example, temperature, and/or pressure in the formation). In certain embodiments, the operating conditions may be selected, varied, and/or maintained to produce desirable properties in hydrocarbons in the produced mixture. For example, the produced mixture may include hydrocarbons that have properties that allow the mixture to be easily transported (for example, sent through a pipeline without adding diluent or blending the mixture and/or resulting hydrocarbons with another fluid). For example, the use of steam injection for heavy oil production in a multi-point production and injection system will result in the produced fluids being maintained at a high temperature while they are being produced from the wellbore. This provides an advantage since the fluid viscosity, which is very temperature dependent, will remain low during production all the way to the surface.

In some embodiments, a system for treating a subterranean hydrocarbon containing formation includes a substantially horizontal wellbore, and one or more packers (crossover tool) positioned in the wellbore. At least one of the packers allows injection of fluid in a subterranean hydrocarbon containing formation while allowing fluid to be produced through the packer or another portion of the wellbore to the surface of the hydrocarbon containing formation. Use of the packer or set of packers described herein provides an alternative flow path in the wellbore, but separated from the injection/production fluid flow path.

In some embodiments, a section of hydrocarbon containing layer between two packers includes multiple fractures or injection/production points. The injected fluid may, in some embodiments, be heated. The packer may allow, during use, fluid communication between a portion of central tubing in the substantially horizontal wellbore and a portion of an annulus of the substantially horizontal wellbore. In some embodiments, the packer (crossover tool) allows, during use, fluid communication between a first portion of an annulus of the substantially horizontal wellbore and a first portion of central tubing in the substantially horizontal wellbore while allowing fluid communication between a second portion of the central tubing in the substantially horizontal wellbore and a second portion of the annulus of the substantially horizontal wellbore. Sections of the wellbore separated by packers may have one or flow pathways that allow fluid to flow towards the wellbore (for example, multiple fractures or injection/production pathways).

In some embodiments, the fluids injected and/or produced through an injection/production wellbore exchanges heat. Exchange of heat allows the injected fluid remains hot and the produced fluid remains hot, and thus less heat loss to the hydrocarbon containing layer is observed. The use of multiple packers in combination with multiple injection and production points in the wellbore may allow sufficient heat to be exchanged to inhibit precipitation or solidification of paraffins in the mobilized hydrocarbons. Thus, wellbore heaters may not be required or externally heating of the wellbore may not be required.

Figure 2:
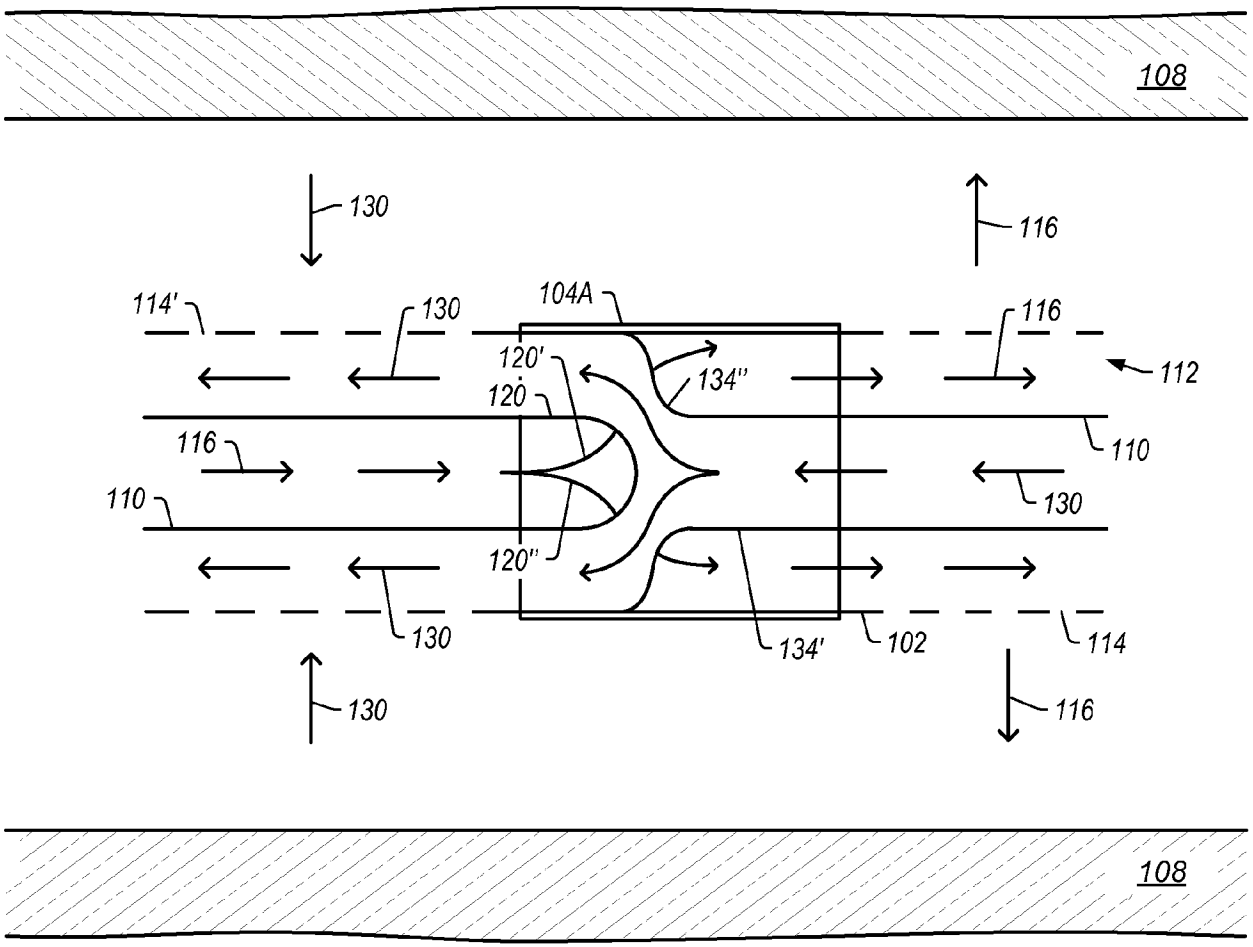
FIG. 2 depicts a cut-away side view of an embodiment of fluid flow through a crossover packer depicted in FIG. 1
Figure 3:
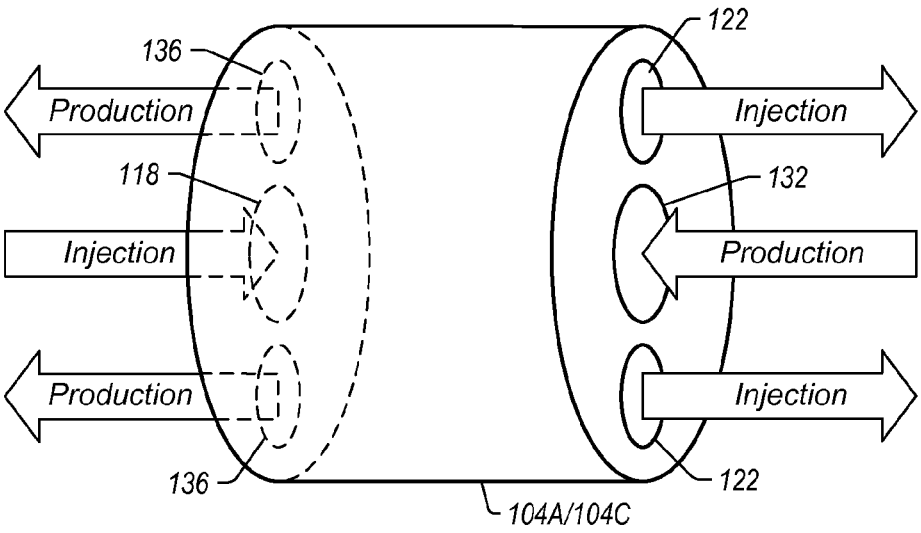
FIGS. 3 and 4 depict side views of embodiments of crossover packers with injection fluid and production fluid.
Figure 4:
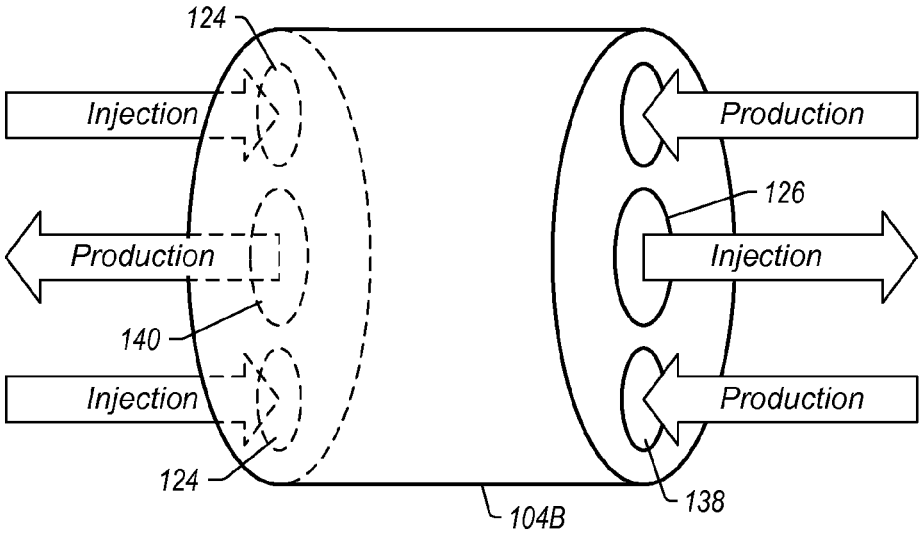
Figure 5:
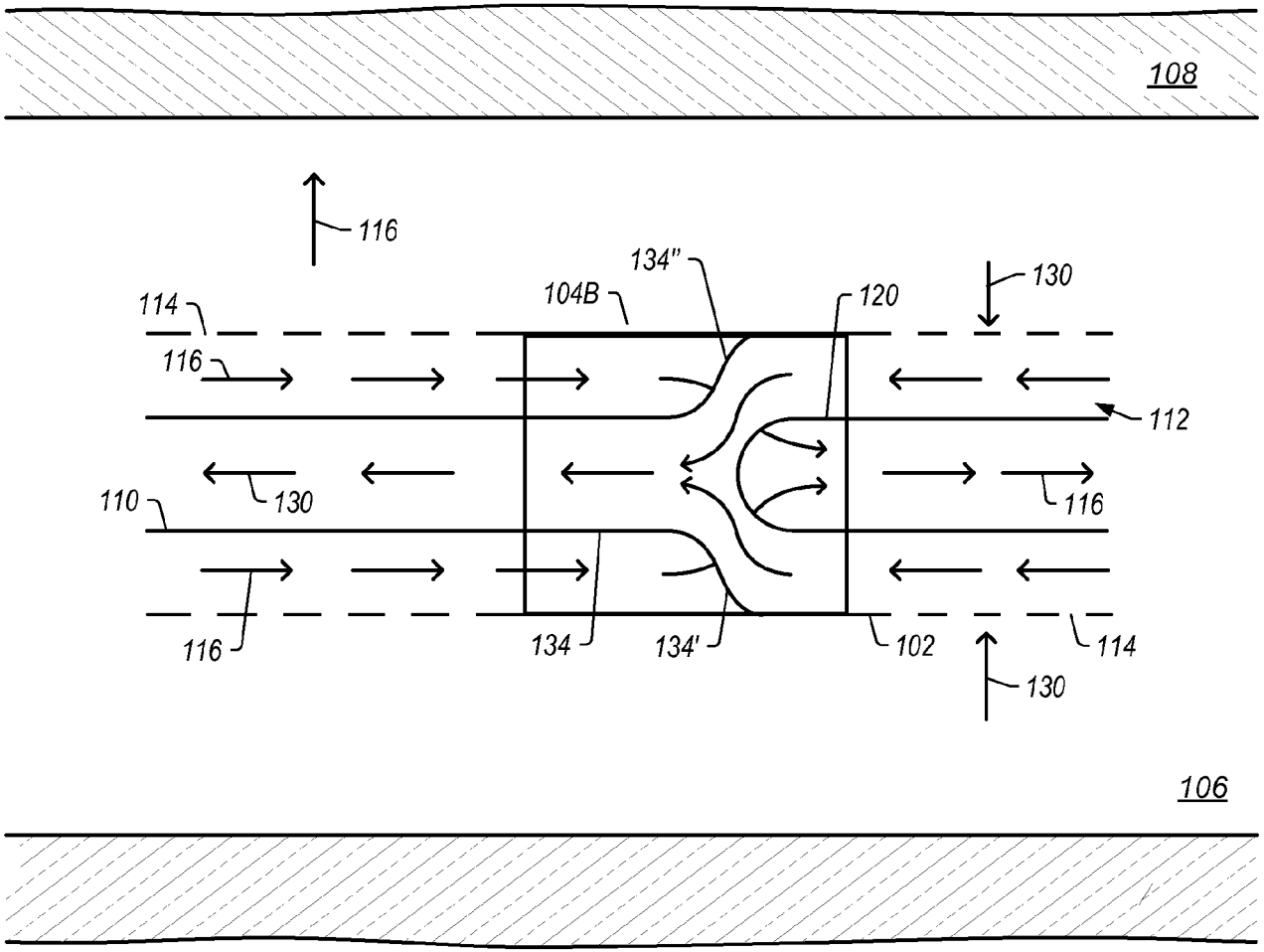
FIG. 5 depicts a cut-away side view of an embodiment of fluid flow through a crossover packer depicted in FIG. 1.

FIG. 1 depicts an embodiment for treating a formation using an injection/production wellbore system. FIG. 2 depicts a side view of an embodiment of fluid flow through a crossover packer. FIG. 3 depicts a side view of packers 104A/104C. FIG. 4 depicts a side view of packer 104B. FIG. 5 depicts a cut-away side view of an embodiment of fluid flow through crossover packer 104B.

As shown in FIG. 1, injection/production system 100 may include injection/production wellbore 102 and one or more packers 104. Substantially horizontal injection/production wellbore 102 may be located in hydrocarbon containing layer 106. Hydrocarbon containing layer 106 may be below overburden 108. Portions of wellbore 102 may be cased and/or uncased. Wellbore 102 may be obtained using conventional horizontal drilling methods. In some embodiments, wellbore 102 is placed in a hydrocarbon containing layer 106 that contains fractures. The fractures may be naturally occurring or may be produced using conventional fracturing methods (for example, hydraulic fracturing, acidizing fracturing, proppants, or the like).

Injection/production wellbore 102 may be used to inject fluid (for example, heated water, steam, chemicals, inorganic acids, organic acids, slurries, emulsions and the like) into hydrocarbon containing layer 106. Packers 104A, 104B, 104C, 104D, are spaced in the substantially horizontal portion injection/production wellbore 102 and are horizontally displaced from each other. In some embodiments, the packers are vertically displaced from each other. Packers 104 (crossover tool) may be made of any material suitable for use in an injection and/or production wellbore. In some embodiments, only packer 104A is used. In other embodiments, a number of packers ranges from 1 to about 10 or greater. It should be understood that the number of packers is only limited by the length and/or spacing in the wellbore. The packers, such as 104A, 104B, 104C, 104D may be different in construction and may be organized and arranged in a different order.

Central tubing 110 is in fluid communication with packers 104 and connects with an injection source at the surface of the formation. Central tubing 110 and the outer walls of wellbore 102 form annulus 112. Injection fluid may be injected in central tubing 110, flow through packers 104, and then out into the hydrocarbon layer through perforations 114 as shown by arrows 116. Injection fluid may mobilize formation fluid in the hydrocarbon layer. Perforations 114 may include covers that open and/or close as needed to control injection and production rated and locations. For example, sliding sleeves may cover perforations 114 and opened and/or closed along the length of the wellbore using one or more controllers.

As shown in and FIG. 3, injection fluid flows through central tubing 110 into opening 118 of packers 104A, 104C. Opening 118 allows fluid communication between wellbore central tubing 110 and injection tubing string 120 of packer 104 as shown in FIG. 2. Injection tubing string 120 in packers 104A, 104C may diverge and form two injection tubing strings 120', 120". In some embodiments, injection tubing string 120 may diverge into at least 3 injection tubing strings, at least 6 injection tubing strings, at least 10 injection tubing strings or more. As shown in FIG. 2, as fluid flows through injection tubing string 120 into injection tubing strings 120', 120", the injection fluid and exits packers 104A, 104C through openings 122 into annulus 112 of the wellbore. The use of the divergent tubing strings allows the fluid to "crossover" from the central tubing of the wellbore to the annulus of the wellbore. A portion of the injection fluid may exit wellbore through perforations 114 as shown by arrows 116.

A portion of the injection fluid that exits from the outlet 122 of packer 104A flows along annulus 112 and enters packer 104B through openings 124 as shown in FIG. 4. In packer 104B, openings 124 allow fluid communication between annulus 112 and injection tubing strings 120', 120". Injection tubing strings 120', 120" may converge to single injection tubing string 120 in packer 104B. As injection fluid flows through packer 104B, the injection fluid converges into tubing string 120 and exits the packer through opening 126. Such convergence of the flow of injection fluid allows the injection fluid to crossover from annulus 112 to central tubing 110 in wellbore 102. The process continues along the length of the wellbore through packer 104C to the end of the wellbore.

Wellbore 102 may include end packer 104D (shown in FIG. 1). End packer 104D may serve as a stop in the wellbore, and/or the annulus, and/or one or more tubing strings. End packer 104D directs flow of injection fluid through perforations 114 and includes openings that allow mobilized hydrocarbons to flow into the wellbore from the hydrocarbon containing formation. In some embodiments, opening 126 of end packer 104D include covers that may be removed to allow injection fluid to flow through the packer and extend the injection process into the subterranean formation.

Contact of the injection fluid with hydrocarbons in the portion of the hydrocarbon layer may reduce the viscosity of the hydrocarbons such that the hydrocarbons in the hydrocarbon section are mobilized. Reduction of hydrocarbon viscosity may occur by heating the hydrocarbon containing formation with heated injection fluid and/or treating the hydrocarbons in the hydrocarbon layer such as with the solvent in the injection fluid. In some embodiments, the injection fluid may be pressurized to a level that hydrocarbons are driven into wellbore 102 through perforations 114'.

Mobilized hydrocarbons (for example, production fluids) may flow through end packer 104D into central tubing 110, and then enter packers 104C, 104B, 104A as shown by arrows 130 in FIG. 1. In some embodiments, heat from injection fluid may heat mobilized hydrocarbons to enhance flow through packers 104 to the surface of the formation. A portion of the hydrocarbons may enter annulus 112 through perforations 114'.

Mobilized hydrocarbons enter packer 104C through opening 132 of production tubing 134 (see, for example, FIGS. 2 and 3). Production tubing string 134 is in fluid communication with wellbore central tubing 110. Central tubing 110 may be in fluid communication with end packer 104D. In packers 104A and 104C, production tubing string 134 diverges into at least two production tubing strings 134', 134". In some embodiments, production tubing string diverges into at least 3 production tubing strings, at least 6 production tubing strings, at least 10 production tubing or more production tubing strings or annuli. Mobilized hydrocarbons flow through production tubing 134 production tubing strings 134', 134" and exits packers 104C, 104A, through openings 136, as shown in FIG. 3. Openings 136 are in fluid communication with wellbore annulus 112. Flow of mobilized hydrocarbons through divergent production tubing strings allows the mobilized hydrocarbons to "crossover" between central tubing 110 and annulus 112. Mobilized hydrocarbons flow through annulus 112 and enter packer 104B from packer 104C through opening 138. Additional mobilized hydrocarbons may also enter wellbore annulus 112 through perforations 114' and flow into packer 104B.

In some embodiments, while fluids are being produced through packer 104C, fluids are being injected into the hydrocarbon layer through the packer as described herein. In packer 104B (see, for example, FIG. 5), production tubing strings 134', 134" converge into production tubing string 134 while injection tubing strings 120', 120" converge to single injection tubing string 120. Such convergence allows mobilized hydrocarbons crossover from wellbore annulus 112 to wellbore central tubing 110 and injection fluids to crossover from wellbore annulus 112 to central tubing 110 in an opposite direction.

Mobilized hydrocarbons exit packer 104B through opening 140 and enter packer 104A through opening 132 (see, FIG. 3). In packer 104A, the mobilized hydrocarbons crossover from central tubing 110 to annulus 112. The process continues through packers 104 until mobilized hydrocarbons reach the surface. Conventional methods, for example, gas lift and/or pressure, may be used to move hydrocarbons through wellbore 102.

Figure 6:
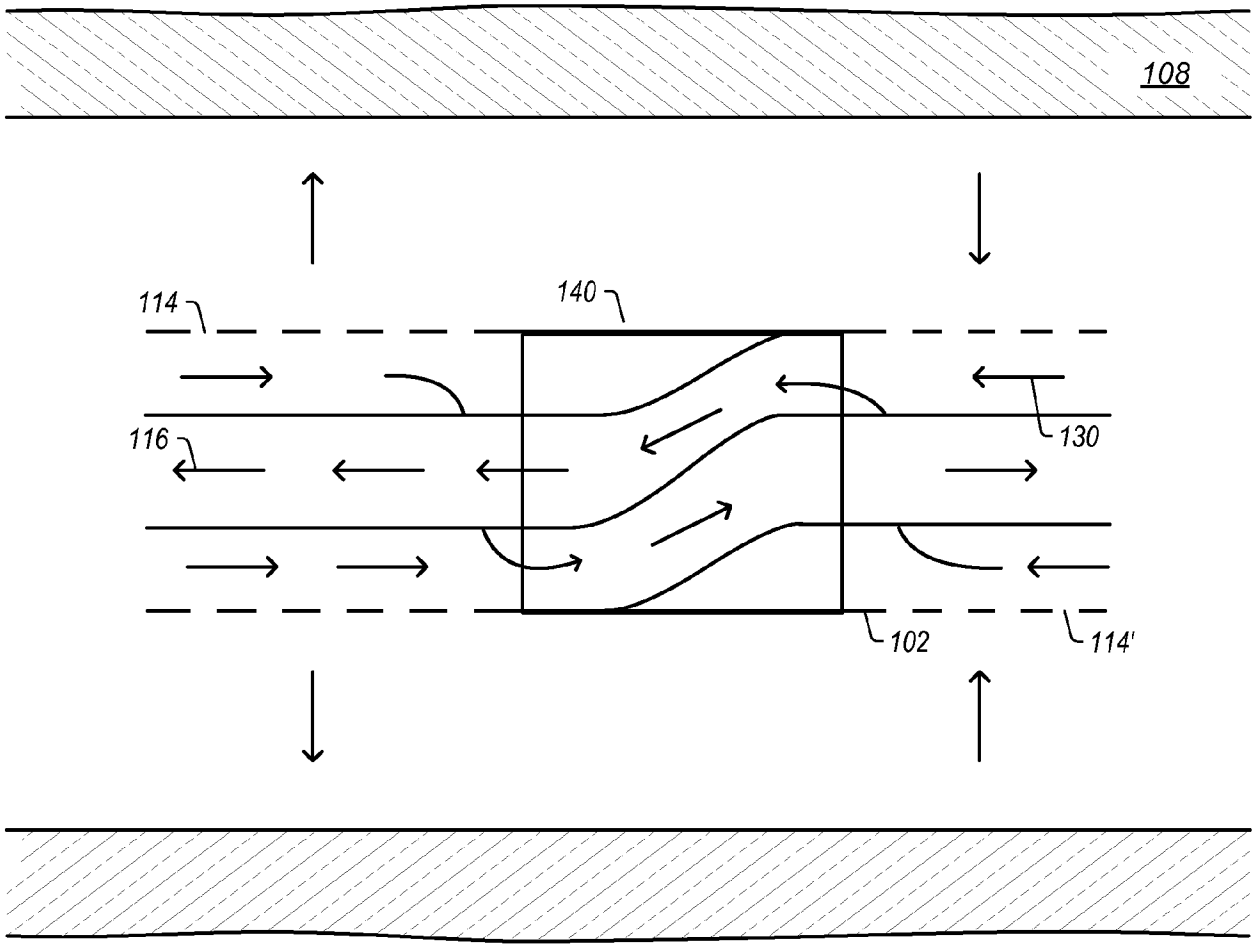
FIG. 6 depicts a cut-away side view of an embodiment of fluid flow through a crossover packer.
Figure 7:
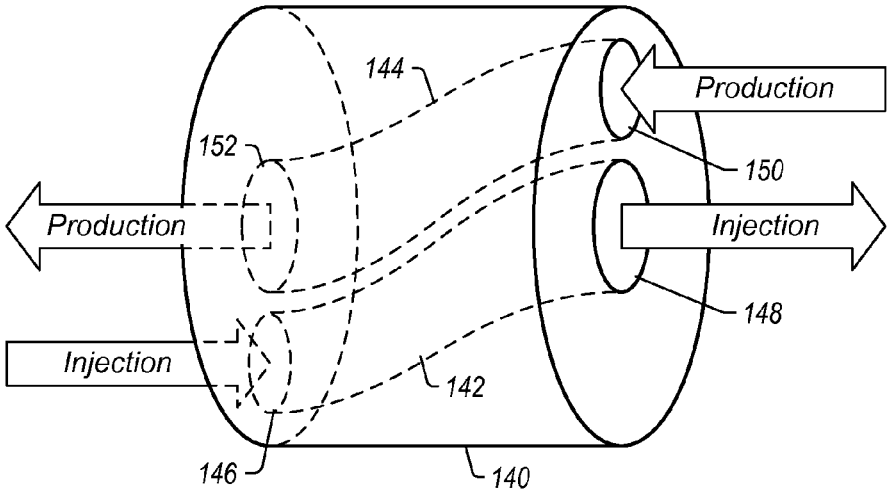
FIG. 7 depicts a side view of another embodiment of a crossover packer.

In some embodiments, the packers allow crossover of fluid from an annulus to the central tubing using a single entry opening and single exit opening. FIG. 6 depicts a cut away side view of wellbore 102 that includes an embodiment of a crossover packer having single entry and exit openings. FIG. 7 depicts a side view of an embodiment crossover packer 140. Crossover packer 140 includes arcuate (curved) tubing 142 and arcuate tubing 144. Arcuate tubing 142 may be vertically/horizontally displaced from arcuate tubing 144. Arcuate tubing 142 allows injection fluid from annulus 112 to enter packer 140 through opening 146, crossover, and exit the packer through opening 148 into central tubing 110 of the wellbore. Arcuate tubing 144 allows mobilized hydrocarbons to enter packer 140 through opening 150 (that communicates with central tubing of wellbore 102), crossover, and exit the packer through opening 152 (that communicates with annulus 112 of the wellbore).

Figure 8:
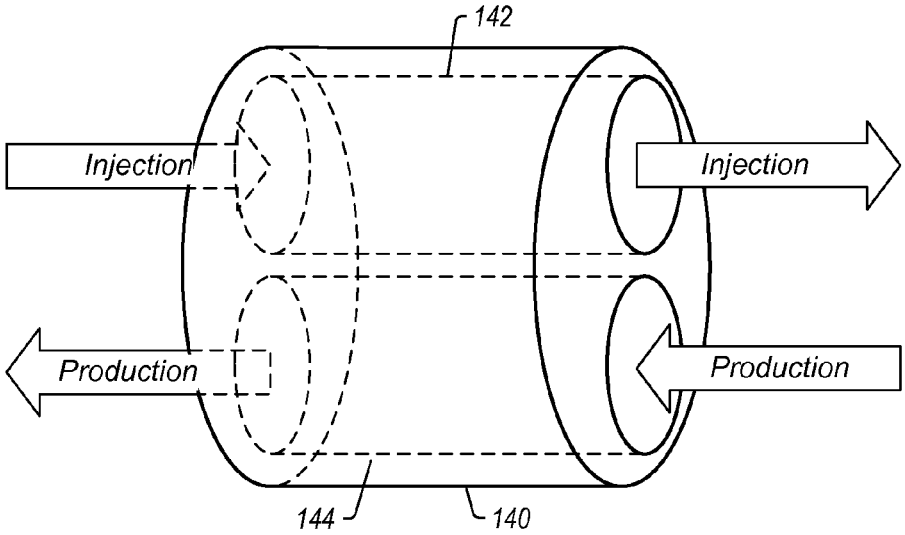
FIG. 8 depicts a side view of a dual tubing packer.
Figure 9:
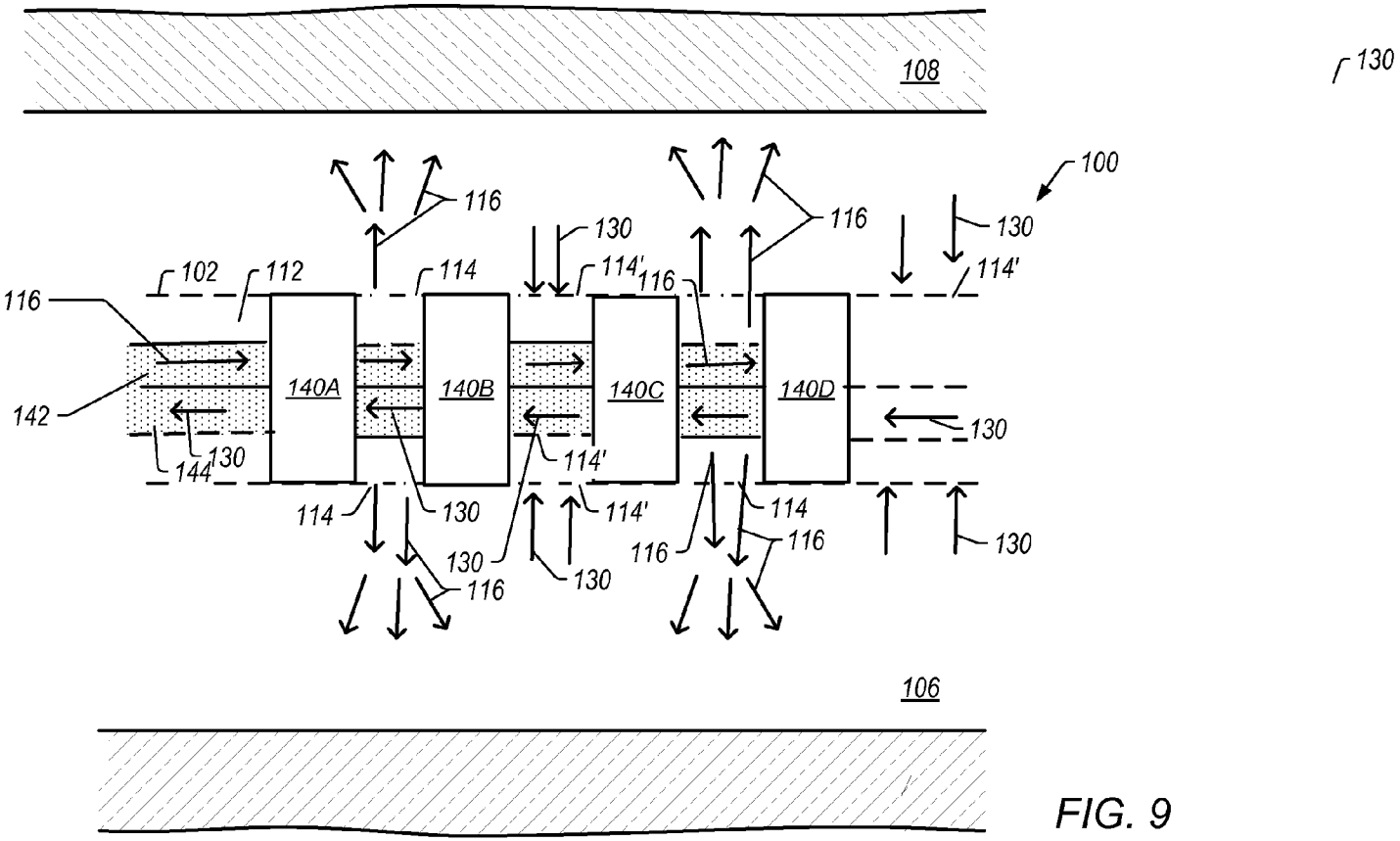
FIG. 9 depicts a side view of an embodiment of injection of fluids and production of hydrocarbons from a hydrocarbon formation using a dual tubing packer.

In some embodiments, injection tubing 142 and production tubing 144 is substantially horizontal and vertically displaced from each other as shown in FIG. 8. Such displacement is advantageous when two or more tubing strings run throughout the horizontal section of the wellbore. As shown in FIG. 9, packers 140 may be positioned in a single wellbore. The wellbore may include perforations that include coverings that allow the perforations to be selectively opened and closed. One or more controllers (for example, a computer) may control the coverings. Fluid may flow through injection tubing 142 (shown in FIG. 8) of packers 140A, 140B, 140C, and 140D. The fluid may exit the wellbore through perforations 114 between packers 140A and 140B and/or perforations 114 between packers 140C and 140D and contact sections of hydrocarbon layer hydrocarbon layer 106 adjacent to the perforations. Mobilized fluids flow into annulus 112 through perforations 114' and enter production tubing 144 (shown in FIG. 8) of packers 140B and 140D.

In some embodiments, perforations 114, 114' may be covered. The covering may be remotely controlled from the surface (for example, connected to a computer controller) to open and close such that injection and/or production may be alternated along the length of the wellbore and/or the coverings may be partially closed or opened to control flow rate. For example, perforations 114 between packers 140C and 140D and/or perforations 114' after packer 140D may be open while perforations 114 between 140A and 140B and/or perforation 114' between 140B and 140C are closed and vise versa. In some embodiments, injection and production is performed simultaneously along the length of the wellbore.

In some embodiments, production and/or injection tubing strings of packers 104, 140 connect to tubing strings of one or more additional packers 142 and/or 104 or other packers in wellbore 102. Flowing fluid through tubing strings may inhibit reactions of injected fluids with production fluids in the wellbore.

Figure 10:
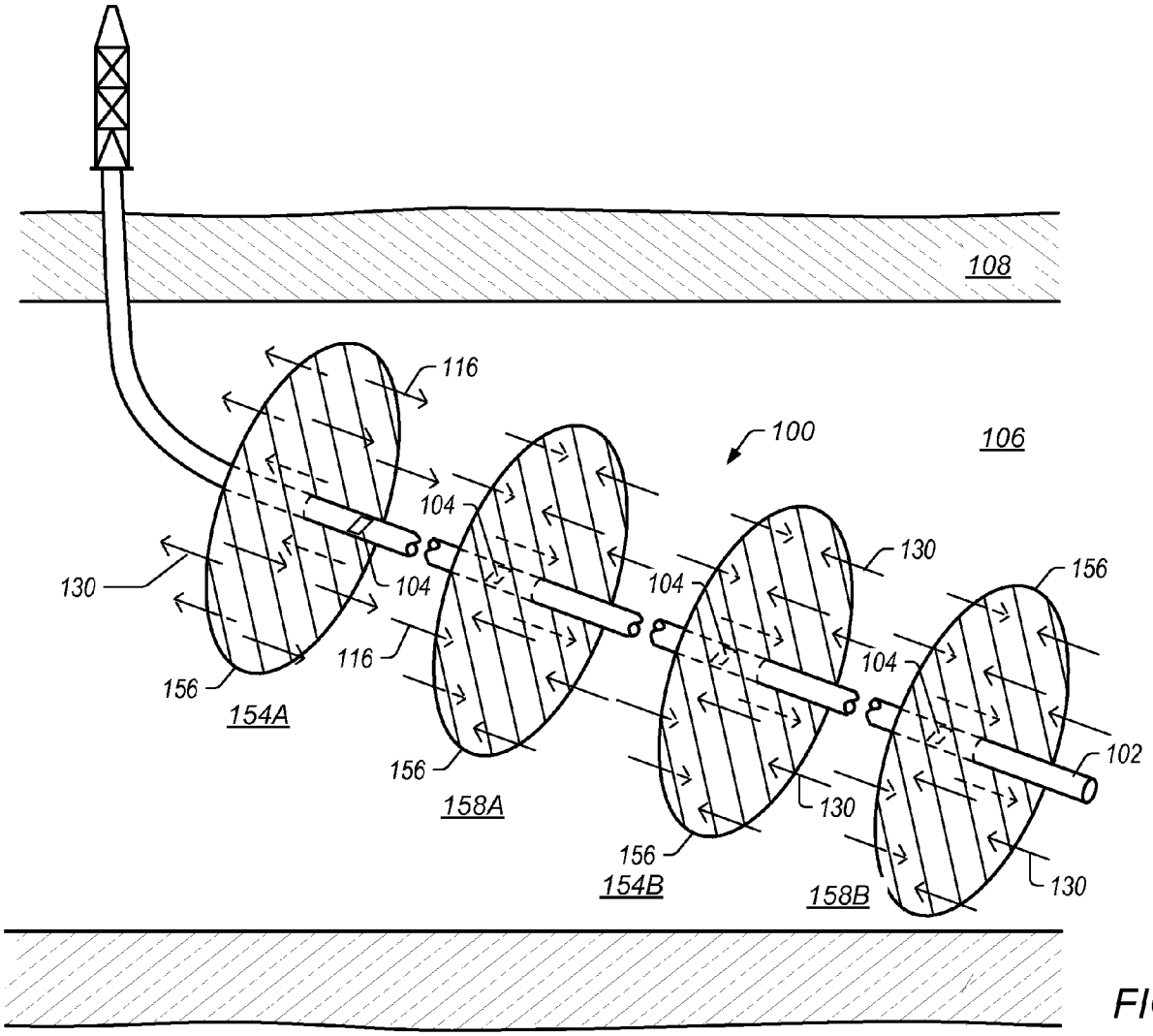
FIG. 10 depicts a schematic of an embodiment of the injection and production from a single wellbore in a fractured well geometry.

In some embodiments, injection and production of fluid using the system described is performed in a fractured hydrocarbon layer. FIG. 10 depicts a schematic of an embodiment of the injection and production from a single wellbore in a fractured hydrocarbon layer. Injection of fluid into section 154 of hydrocarbon containing layer 106 containing fractures 156 through injection/production wellbore 102 containing packers 104. In some embodiments, packers 140 and/or a combination of packers 104 and 140 are used in the single wellbore.

As shown, injected fluid moves formation fluids in section 154A in a linear direction (line drive) as shown by arrow 116. Formation fluids may be produced from section 158B of hydrocarbon containing layer 106 using injection/production wellbore 102. Injection fluid flow through wellbore 102 and enters hydrocarbon section 154B drives formation fluids into section 158B as shown by arrows 130. The formation fluids may be produced from hydrocarbon section 158B using wellbore 102. Packers 104 allow selective injection into section 154A, 154B and/or production from sections 158A, 158B. In some embodiments, packers 140 and/or a combination of packers 104 and 140 are positioned in wellbore 102. Use of multiple points of injection and production where each point of injection and production is a fracture may improve the displacement geometry in the hydrocarbon layer. Improvement in the displacement geometry improves the hydrocarbon displacement and sweep efficiency as compared to conventional five spot or nine-spot injector-producer pattern. An improvement in sweep efficiency leads to improvements in hydrocarbon recovery.

It should be understood that the direction of all the arrows in the Figures may be reversed leading a reversal in roles of all the injection and production zones. Thus, in this embodiment, the central tubing will not be connected to an injection source at the surface but will be used to transport the produced hydrocarbons to the surface. The annulus region between the central tubing and the wellbore, 112 may carry the injection fluid from the surface to the sub-surface. Thus, arrows 130 represent the injection fluid and arrows 116 would represent the produced fluid. The zones where injection occurs into the formation will now become zones where production occurs from the formation and vice versa.

As shown in FIGS. 1-10, multiple injection and production points in a single wellbore have numerous advantages. In some embodiments, an increased sweep of hydrocarbons in the case of alternate injection and production zones and more efficient reservoir drainage may occur. Multiple injection and production points in a single wellbore also leads to a reduction in the time taken to perform fracturing treatments in a wellbore. For example, instead of using the conventional treatment technique of creating one fracture at a time, the injection tubing and the production tubing as to inject fracturing fluid into the formation and create two or more fractures simultaneously in the same wellbore. Thus, reduction in the time needed to create the same number fractures is observed.

Multiple injection and production points in a single wellbore may also be used in conjunction with downhole flow control devices (such as sliding sleeves) to selectively access different injection and production points in the formation. Selective arrangement of multiple packers as described herein and/or fracturing from a single wellbore as described herein may more efficiently create multiple fractures in the wellbore as compared to using the more common plug-and-perforate or ball drop techniques. Access of different injection and production points in the formation may provide a way to implement a particular fracturing sequence. For example, it could be used to increase fracture complexity in a reservoir by using "alternate fracturing". Fractures may created in a 1-3-2-5-4 sequence, where the numbers refer to the location of the fractures starting at the toe. Greater fracture complexity may be achieved in the even numbered fractures. Using the systems and methods describe herein, which uses separate channels of injection and production in the wellbore, and using downhole flow control devices to selectively control the opening and closing of the fluid injection and production ports, one could possibly use the production tubing in the wellbore as injection tubing and create fractures in alternate zones. Time spent in moving the tubing to specific locations may be saved as the down-hole flow control devices are selectively opened and closed to control the locations and sequence of fracturing. Similarly, multiple injection and production points may be used to efficiently fracture the formation in any other customized sequence or order.

In certain embodiments, formation conditions (for example, pressure, and temperature) and/or fluid production are controlled to produce fluids with selected properties. For example, formation conditions and/or fluid production may be controlled to produce fluids with a selected API gravity and/or a selected viscosity. The selected API gravity and/or selected viscosity may be produced by combining fluids produced at different formation conditions (for example, combining fluids produced at different temperatures during an in situ hybrid treatment). In certain embodiments, a mixture is produced from the injection/production well. The produced hydrocarbons may be transportable through a pipeline without adding diluent or blending the mixture with another fluid.

It is to be understood the invention is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise. Thus, for example, reference to "a core" includes a combination of two or more cores and reference to "a material" includes mixtures of materials.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A system for treating a subterranean hydrocarbon containing formation, comprising:

a wellbore in the subterranean hydrocarbon containing formation;

a central tubing along a length of the wellbore, wherein the central tubing is configured to provide an injection fluid into the wellbore;

an annulus between the central tubing and outer walls of the wellbore, wherein the annulus is configured to remove formation fluids from the wellbore;

a first packer positioned in an injection or production section of the wellbore, wherein the first packer defines a first wellbore interval after the first packer, wherein the central tubing before the first packer is in fluid communication with the annulus in the first wellbore interval after the first packer, and wherein the annulus before the first packer is in fluid communication with the central tubing in the first wellbore interval after the first packer;

a second packer positioned in an injection or production section of the wellbore after the first packer and in fluid communication with the first wellbore interval, wherein the second packer defines a second wellbore interval after the second packer, wherein the central tubing before the second packer is in fluid communication with the annulus in the second wellbore interval after the second packer, and wherein the annulus before the second packer is in fluid communication with the central tubing in the second wellbore interval after the second packer; and a third packer positioned in an injection or production section of the wellbore after the second packer and in fluid communication with the second wellbore interval, wherein the third packer defines a third wellbore interval after the third packer, wherein the central tubing before the third packer is in fluid communication with the annulus in the third wellbore interval after the third packer, and wherein the annulus before the third packer is in fluid communication with the central tubing in the third wellbore interval after the third packer;

wherein the annulus in the first wellbore interval is configured to provide the injection fluid into the hydrocarbon containing formation to mobilize formation fluids in the hydrocarbon containing formation, wherein the annulus in the second wellbore interval is configured to allow mobilized formation fluids to enter the wellbore from the hydrocarbon containing formation, and wherein the annulus in the third wellbore interval is configured to provide the injection fluid into the hydrocarbon containing formation to mobilize formation fluids in the hydrocarbon containing formation.

2. The system of claim 1, wherein the outer walls of the wellbore in the first wellbore interval comprise perforations configured to be opened to provide injection fluid into the hydrocarbon containing formation from the annulus in the first wellbore interval or closed to inhibit the injection fluid from entering the hydrocarbon containing formation.

3. The system of claim 1, wherein the outer walls of the wellbore in the second wellbore interval comprise perforations configured to be opened to allow mobilized formation fluids to enter the annulus in the second wellbore interval from the hydrocarbon containing formation or closed to inhibit mobilized formation fluids from entering the annulus in the second wellbore interval from the hydrocarbon containing formation.

4. A method for treating a subterranean hydrocarbon containing formation, comprising:

providing a substantially horizontal or deviated wellbore to a subterranean hydrocarbon containing formation, wherein the wellbore comprises a central tubing along a length of the wellbore, an annulus being defined between the central tubing and outer walls of the wellbore;

providing a plurality of packers to the substantially horizontal or deviated wellbore, wherein the packers are positioned along the central tubing;

providing injection fluid into the wellbore through the central tubing;

switching flow of the injection fluid from the central tubing to the annulus in a first wellbore interval using a first packer;

providing injection fluid to the hydrocarbon containing formation from the annulus in the first wellbore interval;

switching flow of the injection fluid from the annulus in the first wellbore interval to the central tubing in a second wellbore interval using a second packer;

switching flow of the injection fluid from the central tubing in the second wellbore interval to the annulus in a third wellbore interval using a third packer, wherein the second wellbore interval is between the first and third wellbore intervals and the second packer is between the first and third packers;

providing the injection fluid to the hydrocarbon containing formation from the annulus in the third wellbore interval;

mobilizing hydrocarbons in the hydrocarbon containing formation using the injection fluid provided to the hydrocarbon containing formation;

allowing the mobilized hydrocarbons to flow into the annulus in the second wellbore interval from the hydrocarbon containing formation; and producing the mobilized hydrocarbons from the wellbore by switching the flow of the mobilized hydrocarbons from the annulus in the second wellbore interval into the central tubing in the first wellbore interval using the second packer, switching the flow of the mobilized hydrocarbons from the central tubing in the first wellbore interval to the annulus of the wellbore before the first wellbore interval, and producing the mobilized hydrocarbons from the annulus of the wellbore.

5. The method as claimed in claim 4, wherein providing the injection fluid and producing the mobilized hydrocarbons are performed simultaneously.

6. The method as claimed in claim 4, further comprising alternately providing the injection fluid to the hydrocarbon containing formation from the first and third wellbore intervals.

7. The method as claimed in claim 4, wherein the first wellbore interval is horizontally displaced relative to the second wellbore interval.

8. The method as claimed in claim 4, wherein the injection fluid is a hydrocarbon recovery enhancing fluid, the hydrocarbon recovery enhancing fluid comprising a miscible fluid, an immiscible fluid, gas, water, and/or steam.

9. The method as claimed in claim 4, wherein the wellbore is positioned in a fracture of the subterranean hydrocarbon containing formation.

10. The method as claimed in claim 4, further comprising fracturing a portion of the subterranean hydrocarbon containing formation prior to providing the substantially horizontal or inclined wellbore to the subterranean hydrocarbon containing formation.

11. The method as claimed in claim 4, further comprising drilling an opening in the formation prior to providing the substantially horizontal or inclined wellbore to the subterranean hydrocarbon containing formation.

12. The method as claimed in claim 4, further comprising allowing the mobilized hydrocarbons to flow into the annulus in a fourth wellbore interval from the hydrocarbon containing formation, wherein the fourth wellbore interval is adjacent to the third wellbore interval.

13. The method as claimed in claim 4, wherein the injection fluid flows through the first packer in an opposite direction that the mobilized hydrocarbons flow through the first packer.

14. The method as claimed in claim 4, wherein a portion of the injected fluid exchanges heat with a portion of the produced mobilized hydrocarbons.

15. The method as claimed in claim 4, wherein the hydrocarbon containing formation comprises one or more fractures, injection points, or production points.

16. The method as claimed in claim 4, wherein the injection fluid comprises acid and a portion of the wellbore is stimulated using the acid.

17. The method as claimed in claim 4, further comprising pressurizing a portion of the injection fluid to fracture a portion of the hydrocarbon containing layer.

18. A method for injecting and producing from a single wellbore in a subterranean hydrocarbon containing formation, comprising:

flowing injection fluid in a central tubing in an upper portion of the wellbore, wherein the central tubing extends through the upper portion of the wellbore into one or more wellbore intervals downhole from the upper portion of the wellbore;

switching flow of the injection fluid from the central tubing in an upper portion of the wellbore to an annulus of the wellbore in a first wellbore interval using a first packer positioned in the wellbore at a first end of the first wellbore interval, wherein the first packer isolates the annulus in the first wellbore interval from the annulus in the upper portion of the wellbore;

providing the injection fluid to at least a first section of the hydrocarbon containing formation from the first wellbore interval;

mobilizing formation fluids from the first section to at least a second section of the hydrocarbon formation using the injection fluid, the second section being located adjacent to the first section and at least partially horizontally displaced from the first section;

producing mobilized formation fluids from the annulus in a second wellbore interval, wherein producing the mobilized formation fluids from the annulus in the second wellbore interval comprises:

switching flow of the mobilized formation fluids from the annulus in the second wellbore interval to the central tubing in the first wellbore interval using a second packer positioned in the wellbore at a second end of the first wellbore interval, the second end of the first wellbore interval being a junction of the first wellbore interval and the second wellbore interval, wherein the second packer isolates the annulus in the first wellbore interval from the annulus in the second wellbore interval; and switching flow of the mobilized formation fluids from the central tubing in the first wellbore interval to the annulus in the upper portion of the wellbore using the first packer;

switching flow of the injection fluid from the annulus in the first wellbore interval to the central tubing in the second wellbore interval using the second packer;

switching flow of the injection fluid from the central tubing in the second wellbore interval to the annulus in a third wellbore interval using a third packer, wherein the second wellbore interval is between the first and third wellbore intervals and the second packer is between the first and third packers; and providing the injection fluid to at least a third section of the hydrocarbon containing formation from the third wellbore interval.

19. The method of claim 4, wherein the injection fluid is provided into the wellbore through the central tubing.

20. The method of claim 4, wherein the mobilized formation fluids enter the wellbore through the annulus in the second wellbore interval.

21. The method of claim 18, wherein the single wellbore comprises a plurality of additional intervals in the wellbore, the additional intervals including odd intervals alternating with even intervals, each of the intervals being separated by a packer that provides crossover flow for the injection fluid and the mobilized formation fluids between the central tubing in the wellbore and the annulus of the wellbore, wherein the first even interval is the first interval after the third interval in the wellbore, the method further comprising:

providing injection fluid to a plurality of odd sections of the hydrocarbon containing formation from the odd intervals of the wellbore;

mobilizing formations fluids from the odd sections to even sections of the hydrocarbon containing formation, the even sections being at least partially horizontally displaced and alternating with the even sections in the hydrocarbon containing formation; and producing the mobilized formation fluids from the even sections through the even intervals of the wellbore.

22. The method of claim 21, wherein providing the injection fluid from the odd intervals of the wellbore and producing the mobilized formation fluids through the even intervals of the wellbore increases sweep in the hydrocarbon containing formation and reduces a time for producing pressure response in the even intervals to injection of the injection fluid from the odd intervals.

23. The method of claim 18, further comprising independently controlling a rate of providing injection fluid from the first wellbore interval and the third wellbore interval and a rate of producing the mobilized formation fluids through the second wellbore interval.

24. The method of claim 23, wherein the rate of providing injection fluid from the first wellbore interval and the third wellbore interval and the rate of producing the mobilized formation fluids through the second wellbore interval are independently controlled using a first flow control device in the first wellbore interval a second flow control device in the second wellbore interval, and a third flow control device in the third wellbore interval, and wherein the first flow control device, the second flow control device, and the third flow control device are independently operated.

* * * * *